US008935897B2

(12) United States Patent
Shaw

(10) Patent No.: US 8,935,897 B2
(45) Date of Patent: Jan. 20, 2015

(54) FIRE-BARRIERS FOR STRAIGHT-LINE AND INTERSECTING EXPANSION-SPACES HAVING MALE AND FEMALE COUPLING-ENDS

(75) Inventor: Alan Shaw, Lockport, NY (US)

(73) Assignee: Fireline 520, LLC, Buffalo, NY (US)

( * ) Notice: Subject to any disclaimer, the term of this patent is extended or adjusted under 35 U.S.C. 154(b) by 39 days.

(21) Appl. No.: 13/360,071

(22) Filed: Jan. 27, 2012

(65) Prior Publication Data

US 2012/0117900 A1 May 17, 2012

Related U.S. Application Data

(63) Continuation-in-part of application No. 12/855,639, filed on Aug. 12, 2010, now abandoned, which is a continuation-in-part of application No. 11/863,932, filed on Sep. 28, 2007, now abandoned.

(60) Provisional application No. 60/847,951, filed on Sep. 28, 2006.

(51) Int. Cl.
*E04B 1/68* (2006.01)
*E04B 1/94* (2006.01)

(52) U.S. Cl.
CPC ..... *E04B 1/948* (2013.01)
USPC ..... 52/396.04; 52/125.2; 52/127.7; 52/232

(58) Field of Classification Search
CPC ..... E04B 1/948; E04B 1/94
USPC ..... 52/1, 232, 396.01, 396.04, 396.05, 52/406.1, 406.2, 127.7, 125.2
See application file for complete search history.

(56) References Cited

U.S. PATENT DOCUMENTS

| | | | | | |
|---|---|---|---|---|---|
| 4,517,779 | A | * | 5/1985 | Dunsworth | 52/232 |
| 4,566,242 | A | * | 1/1986 | Dunsworth | 52/396.01 |
| 4,811,529 | A | * | 3/1989 | Harris et al. | 52/396.01 |
| 4,848,044 | A | * | 7/1989 | LaRoche et al. | 52/58 |
| 4,866,898 | A | * | 9/1989 | LaRoche et al. | 52/396.01 |
| 4,942,710 | A | * | 7/1990 | Rumsey | 52/396.01 |
| 4,977,719 | A | * | 12/1990 | LaRoche et al. | 52/396.01 |
| 5,263,293 | A | * | 11/1993 | Gohlke et al. | 52/396.01 |
| 5,461,838 | A | * | 10/1995 | Heller | 52/396.01 |
| 5,875,598 | A | * | 3/1999 | Batten et al. | 52/396.01 |
| 5,974,750 | A | * | 11/1999 | Landin et al. | 52/396.01 |

(Continued)

FOREIGN PATENT DOCUMENTS

JP 2001115566 A * 4/2001

*Primary Examiner* — Brian Glessner
*Assistant Examiner* — Jessie Fonseca
(74) *Attorney, Agent, or Firm* — Patricia M Costanzo

(57) ABSTRACT

Fire-barriers systems, including pre-assembled intersecting and straight-line fire-barriers having either all male-, all female-, or both types of coupling ends eliminate on-site cutting and construction of barriers required for intersection-spaces and provide easy, rapid, and safe one-step, drop-in installation and coupling. All male/female ended fire-barriers are constructed as single-piece units. All adjacent laid-flat layers are continuously connected having no gaps or folds. Straight-line and L-shaped barriers are certified according to the criteria mandated by both the ASTM E 1399-97 (Reapproved 2005), *Standard Test Method for Cyclic Movement and Measuring the Minimum and Maximum Joint Widths of Architectural Joint Systems* and the UL 2079 *Fire Resistance of Building Joint Systems Test* for air leakage (Revised and relocated as 1.14 Mar. 10, 2006).

20 Claims, 13 Drawing Sheets

(56) References Cited

U.S. PATENT DOCUMENTS 6,112,488 A * 9/2000 Olson et al. ..... 52/393
6,128,874 A * 10/2000 Olson et al. ..... 52/232
6,131,352 A * 10/2000 Barnes et al. ..... 52/396.01
6,192,641 B1 * 2/2001 Andraso et al. ..... 52/396.01
6,996,944 B2 * 2/2006 Shaw ..... 52/232
2003/0005657 A1 * 1/2003 Visser et al. ..... 52/396.01
2004/0083668 A1 * 5/2004 Hilburn ..... 52/393
2005/0102941 A1 * 5/2005 Barr ..... 52/459

* cited by examiner

How to Apply Fire Blanket to Metal Bracket

How Tools are Attached to L-Bracket

FIRE-BARRIERS FOR STRAIGHT-LINE AND INTERSECTING EXPANSION-SPACES HAVING MALE AND FEMALE COUPLING-ENDS

CROSS-REFERENCE TO RELATED APPLICATIONS

This Continuation-In-Part Application for Patent claims the benefit of United States Continuation-In-Part patent application Ser. No. 12/855,639, filed Aug. 12, 2010 now abandoned, claiming benefit to United States Non-Provisional patent application Ser. No. 11/863,932 filed Sep. 28, 2007 2010 now abandoned, claiming benefit to U.S. Provisional Patent Application No. 60/847,951 filed Sep. 28, 2006.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire-barriers for installing in expansion-joint-spaces and more particularly to pre-assembled fire-barriers constructed with male and female coupling-ends for one-step drop-in installation of the barriers into straight-line and intersecting expansion-spaces.

The background information discussed below is presented to better illustrate the novelty and usefulness of the present invention. This background information is not admitted prior art. The particular versions of the invention as described below are provided, in part, as illustrative and exemplary. Thus, the described versions should not be taken as limiting. Additionally, the invention is not limited to the examples provided.

Buildings and other structures are known to experience stress from many sources, such as extreme and/or repetitive changes in temperature, the force of high impinging winds, compression and expansion forces due to seismic events, settling of subsoil, building remodels, and excavation on or near the site. To minimize the effect of these stresses on the buildings or other structures, building codes now require that all structures must be constructed with spaces between adjacent wall, floor, and ceiling building units. These spaces, commonly referred to as "expansion-spaces," "expansion-spaces" or "expansion-joint-spaces," allow differential building movement to take place without risking damage to the structure, and thus are frequently referred to as "dynamic expansion-spaces".

While expansion-spaces improve the life-time integrity of structures, they present a major risk in the event of a fire because the channels created by the expansion-spaces act as chimney flues providing pathways for gases, flame, and smoke to spread rapidly throughout the structure. To counter the flue effect, building codes for commercial or public structures generally require certified fire-barriers to be installed in the expansion-spaces to reduce or prevent the spread of flames, smoke, and gas through the spaces into adjoining areas. Fire-barriers protect both the structure and those who are within the structure by extending the time available for inhabitants to leave and for fire fighters to get to the fire.

During a fire, buildings and their fire-barriers are subject to even greater stress than usual, making it essential that the fire-barriers are able to retain their integrity. Accordingly, fire-barriers are legally mandated to be tested, rated, and certified. There are two currently mandated tests. One measures the ability of a fire-barrier to maintain its structural integrity under compressional and tensional motion. This test is referred to as the "cycle" test and its parameters are specified by ASTM 1399. The other test is referred to as the "fire" or "burn" test and its parameters are specified by UL 2079. The two tests are conducted in sequence. A fire-barrier is first cycled 500 times between the compression forces and tension forces and then, if the barrier passes the cycle test, it is placed into a furnace where it is tested for its ability to resist and prevent flame, heat, and gases from passing through the barrier.

Fire-barrier structures include "straight-line" fire-barrier structures made to be installed in the expansion spaces between the straight, continuous, parallel, segments of walls, ceilings, or floor units. Other fire-barrier structures include what is referred to as expansion-space-intersecting fire-barriers that are each shaped for fitting into one of the many geometrically complex spaces created by the intersection of two or more expansion-spaces. Examples of intersecting joint spaces include the "cross-shaped" intersection-space that results from the intersection of two straight-line expansion-joint-spaces that intersect at a 90 degree angle, or where the joint space between two spaced adjacent interior walls abuts the space between an exterior wall and the two spaced adjacent interior walls creating a "T"-shaped intersection-space. In the past, the only code tested and certified fire-barriers commercially available were straight-line fire-barriers. Before the present invention, there were no tested, rated, and certified expansion-space-intersecting fire-barriers.

SUMMARY

The present Inventor recognized that the manufactured on-site barriers that were being used to fill the expansion-space-intersecting-spaces may likely not pass the cycle and fire tests. One problem with constructing barriers on-site is that they are constructed from parts of sectioned straight-line barriers. However, when any tested, rated, and certified fire-barrier is modified in any way, it immediately loses its certification and rating. To be able to use the on-site constructed barriers, builders must have their engineers certify the barriers. That does not mean, however, that these on-site constructions are capable of passing the extension/compression and fire-test, which could result in a building and its occupants being at a serious risk in the event of a fire. Moreover, in order to fit an especially long straight-line section several barriers or sections of barriers must be spliced together. The present inventor feared that spliced seams between sections of straight-line barriers and between straight-line barriers and expansion-space-intersecting fire-barriers could allow hot air, smoke, toxic gases, and fire to travel throughout the expansion-joint-spaces of a building. Furthermore, as the connections formed during the requiring splicing procedures, are sometimes simply staples, and as spliced barriers have been known to be installed by non-specialists, they may not stand up to even relatively mild stresses of tension/compression and/or shear movements. Furthermore, the present Inventor realized that not only is on-site assemblage and splicing of fire-barriers inherently an unsafe practice, it is time-consuming and often the barriers so produced often require more than one installation person, which all adds significantly to the total construction cost. Moreover, he realized that on-site assembling could and likely did expose workers hands and arms to being cut by the thin sheets of stainless steel that are often a part of a fire-barrier, and that whenever the installers would cut the fiber glass (or similar material) blankets breathable sized fibers are introduced into the workplace atmosphere resulting in increased worker's insurance. The present inventor recognized how beneficial to the worker, the contractor, and the building owner it would be to have fire-barriers, both those for fitting into straight-line expansion spaces and those for fitting into intersecting-expansion-spaces, pre-assembled with male and female coupling-ends that provide not only for one-step drop-in installation of all of the styles of barriers into their respective expansion spaces, but for self-coupling of each barrier to its adjacent barrier as part of the drop-in installation while avoiding any gaps such are seen in other barriers. Such an improved product would greatly reduce both the time it takes to install the barriers and the health risks, thus cutting the cost of construction and worker's liability insurance.

Thus, the present Inventor recognized that without better fire-barriers, life and property would continue to be at increased risk whenever there was a fire in a building mandated to have expansion-joint spaces. He contemplated that to be able to have code-tested and rated geometrically complex intersection-space fitting fire-barriers, each barrier should be designed and constructed to have continuous-piece construction, and to have no openings or gaps through the barrier so as to prevent providing a pathway for the travel of smoke, fire, or gases. The present inventor also believed that he could design ways to connect adjacent barriers to each other to avoid the gaps that exist in the designs currently used, so that an entire family of straight-line and expansion-space-intersecting fire-barriers could all be tested, rated, and certified by an approved testing agency.

Accordingly, the present inventor designed and manufactured both straight-line and intersection-space fire-barriers according to the following inventive principles: (1) straight-line fire-barriers are to be one-piece contiguous units having male and female coupling-ends; (2) intersecting-expansion-joint-spaces fire-barriers are to be one-piece contiguous units having male and female couple-able ends; (3) all fire-barriers made according to these inventive principles are to be tested, rated, and certified by both the ASTM 1399 specified "cycle" test and the UL 2079 specified "fire" or "burn" test; (4) all fire-barriers described herein are to be pre-fabricated in a certified facility following a certified procedure that is mandated by the specifications of the fire and cycle tests. Prefabrication means that the male/female ended barriers are designed and pre-manufactured according to specification to be delivered to the work site ready for installation, and (5) all barriers are constructed to have at least one or more layers of superimposed refractory insulation blanket underlaid by at least one layer of refractory protective cloth. The male/female coupling-ended fire-barriers of the present invention do not cost anymore to manufacture than do those that do not have male/female coupling abilities. Moreover, if installed with optional, fire-barrier specific, installation tools, even more time and cost is saved, work-site safety is greatly improved, and the general fire safety risk that is created when a contractor doesn't understand the detailed requirements of fire-barrier installation is reduced, especially when the fire-barriers are being installed in intersecting expansion-joint-spaces. In short, the fire-barriers of the present invention comprise the following principles. All of the fire-barriers are either male/female, female/female, or male/male ended fire-barriers shaped for installation into either straight-lined or intersecting-expansion-spaces; each fire-barrier has a plurality of superimposed laid-flat layers, comprising, at least one protective blanket underlying at least one insulation blanket and at least one fire-resistant support sheet, and at least two support brackets attached to said plurality of layers. Each fire-barrier comprises at least a first set of layers, each set containing some of the plurality of superimposed laid-flat layers, and a second set of layers containing at least one of the plurality of superimposed laid-flat layers where the first set superimposed in a laid-flat manner upon the second set and the second set are lengthwise offset from each other providing for the fire-barrier having at least one lengthwise male coupling end and one female coupling end or having all female ends or all male ends, and wherein each layer of each layer of a set has at least one lengthwise outer end and where each lengthwise outer end is aligned with each of other lengthwise outer ends of the same set forming a commonly aligned end for each set.

The fire-barriers of the present invention are unique in several ways. One point of novelty is that both intersection-space and straight-line barriers are available as tested, rated, and certified pre-assembled barriers, all having female/male coupling-ends. One example, provided herein as a favored embodiment, is an L-shaped fire-barrier (also referred to as a horizontal/vertical barrier) having male/female connecting ends that can be installed in a one-step, drop-in process into a L-shaped intersecting-expansion-joint-space created by the convergence of the expansion spaces between two building structures, such as a floor and a wall or a wall and a ceiling. The L-shape, as illustrated, however, is only one of a large number of possible configurations that can be embodied with the principles of the present invention. The invention contemplates one-piece, male/female coupling-ended barriers shaped for fitting into cross-shaped, T-shaped, and L-shaped intersecting-expansion-spaces. It should be noted that L-shaped barriers may also be manufactured having additional horizontal/horizontal arms. All of the barriers manufactured according to the inventive principles described herein are available having female connections, male connections, or both, depending on the specific configuration of the intersecting-expansion-spaces. The interdigitating female/male coupling-ends taught herein require only a bead of fire-resistant caulk to be applied over the seams between the two coupled barriers. No cutting or stapling, or other attachments are required by the overlapping coupling-ends. Once barriers are coupled there are no gaps in the coupled areas which is due to the fact that there is no extension of the outer protective cloth along its long axis, so as to provide for the protective cloth to cover the insulation blanket layers throughout the male/female interdigitating area. Not having such an extended length of protective cloth folded over the male or female shaped ends prevents the creation of a gap where the extended protective cloth is folded over the insulation blanket layers and so must "bend" around the offset layer(s) of insulation blanket. In the barriers of the present invention, one layer of refractory material is laid flat against its adjacent layer. Thus there are only flat layers adjacent to flat layers, that is, all layers are laid-flat, and there is no folding or pleating with a layer. Thus, there need be no holes punched into the insulation blankets and protective cloth to bring them close together and to attach them, and following, there are no holes through the totality of the overlapping sections in the coupled areas, as no wire or other attachment means goes through the overlapped areas so as to attach the overlapping female/male portions to each other. Additionally, each style of male and female ended fire-barrier is supplied with its own optional reusable installation tool that provides for even quicker, easier, and safer one-step, drop-in installation of both the pre-assembled, female and male ended multi-directional/multi-dimensional and straight-line fire-barriers. The installation tools are not only reusable, but also easily and rapidly size-adjustable for use with differently sized versions of the same style barriers.

Another advantage provided by the principles of the present invention is that there is no metal layer under-laid the protective cloth, such as happens when others use loosely woven screening as innermost and outermost layers to provide support for the inner insulation layers. In such as case, the loosely woven screening outer layer are not attached to the insulation layers that are enclosed and supported by the screening which provides for gaps in the barrier through which fire, gases, and smoke can penetrate. Or, as where yet other barriers rely on solely on an outer layer of metal mesh that is attached to the blankets and protective cloth is support. These barriers suffer not only from dangerous gaps caused by the different lengths of protective cloth and of insulation blanket, but it is well-known that metal deforms at even relatively low fire temperature to loose its integrity and can melt relatively early in a fire.

The Softwood Export Council reports that steel often melts at around 1370° C. (2500° F.), but that steel does not have to melt to lose its usefulness. Once it reaches its yield point it will begin to deform plastically and even before reaching its yield point it will deform elastically, at which point the barrier would fail. Temperatures inside a burning building range from approximately 700° C. (1292° F.) to 900° C. (1292° F.). Steel weakens dramatically as its temperature climbs above 230° C. (446° F.), retaining only 10% of its strength at about 750° C. (1382° F.). Wikipedia also reports that when heated, steel expands and once enough energy has been absorbed, it softens and losses its structural integrity. The Softwood Export Council gives the example of the McCormick Place exhibition hall fire in Chicago, Ill. All of the structural members of this large exhibition hall were constructed of non-combustible materials. In 1967, a fire quickly spread through the contents of the hall, generating temperatures so high that steel beams, girders and trusses buckled in the heat and the entire roof collapsed. After this fire, the goal has become "fire safe" design, rather than "fireproof," and it can be achieved when the right materials are used. Using metal that would be directly exposed to a fire in the case of a fire is not "fire safe" design.

The attachment support brackets of the present invention include solid, rigid, fire resistant flanges (L-brackets are shown in the illustrated examples) that support the layers of the fire-barriers of the present invention, which layers are all attached to each other and to the brackets, but which layers are attached indirectly. That is, in some cases some of the layers are attached to an outmost solid support bracket while other layers are attached to an inner solid bracket with the brackets being attached to each other leaving no opportunity for gaps. Because the layers are attached indirectly, no opening is created through the total thickness of the fire-barriers of the present invention. In other cases, the layers may be all attached to each other only in the portions of the barrier that do not make up the overlapping male/female coupling-ends. In the male/female coupling areas only the sheets or layers that make-up each of the overlapping areas are attached to each other. The male end is not attached to the female end of the interdigitating (overlapping) areas. Only a little refractory caulk is placed over seam areas.

Each of the claimed fire-barriers have been tested, rated, and certified in July 2007 at the Intertek Testing Labs in San Antonio, Tex. 78226 according to the criteria mandated by both the ASTM E 1399-97 (Reapproved 2005), *Standard Test Method for Cyclic Movement and Measuring the Minimum and Maximum Joint Widths of Architectural Joint Systems* commonly referred to as the "cycle" test, and the UL 2079 *Fire Resistance of Building Joint Systems Test* for air leakage (Revised and relocated as 1.14 Mar. 10, 2006) and commonly referred to the "fire" or "burn" test.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1:
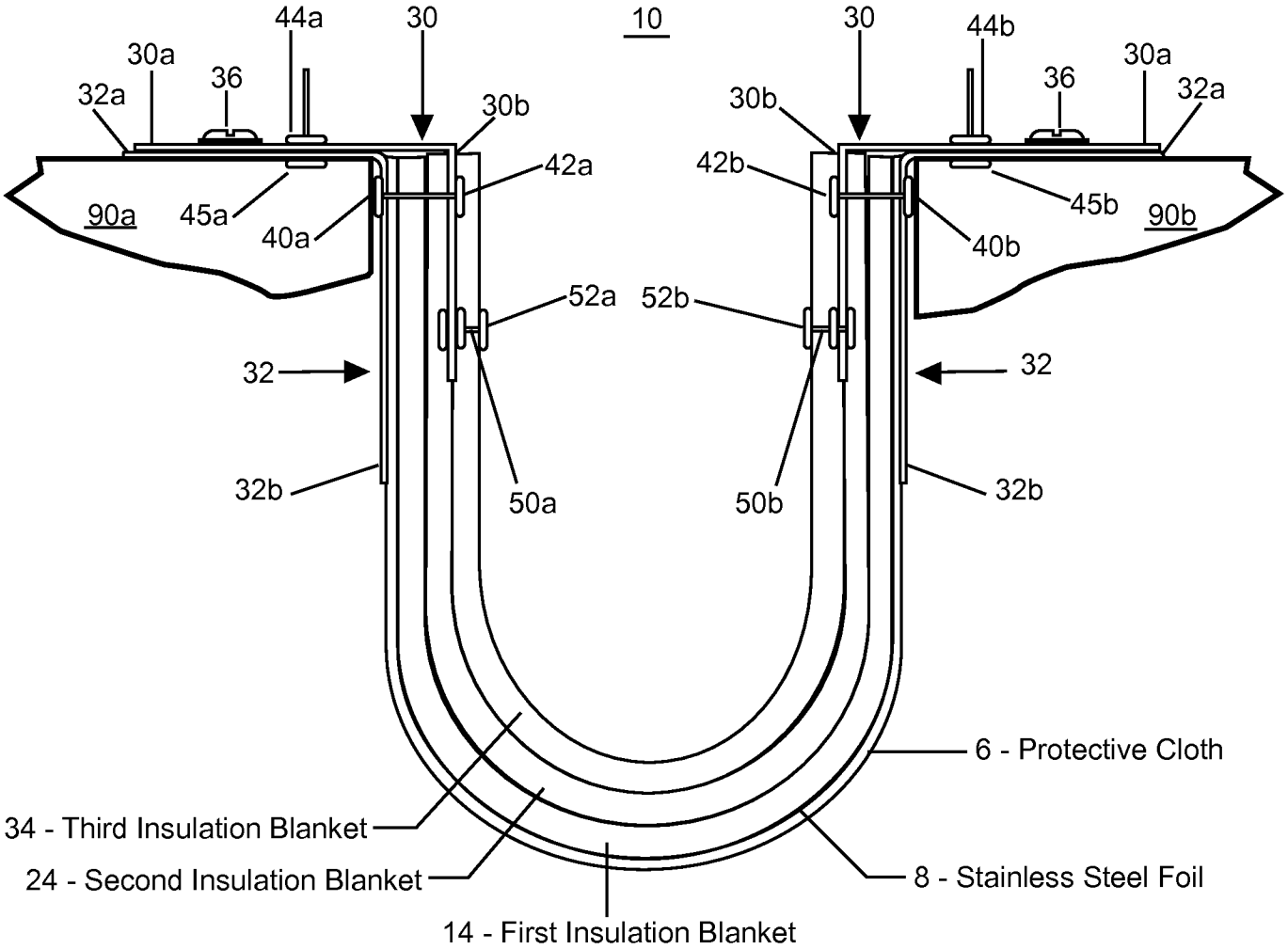
FIG. 1 is a diagrammatic cross-section view of a top-mount fire-barrier constructed according to the principles of the present invention and installed in an expansion joint.

Building units, as used herein, refers to structures such as walls, floors, ceilings, and the like, and may be referred to as structural units.

Expansion-space, as used herein, refers to the spaces between adjacent wall, floor, and ceiling building units that are mandated by present day building codes to prevent the stresses suffered by buildings and other structures from temperature changes, earthquake motions, and wind, for example do not compromise the integrity of the buildings or other structures. These spaces are commonly referred to as "expansion-spaces" or "expansion-joint-spaces" and allow differential building movement to take place without risking damage to the structure, and are, thus, often referred to as dynamic expansion-spaces. Included under the term of expansion-space are the spaces created when two or more expansion-spaces intersect, creating an intersection-space that is much more geometrically complex; also see the definition for "Intersection-spaces" below.

Insulation blanket, as used herein, of thick refractory blankets made from any number of insulation materials, including alumina, zirconia, and silica spun ceramic fibers, fiberglass, and the like. For example, Fiberfrax's Durablankets are high-temperature insulation blankets made from long-staple, inorganic spun fibers, needled to produce exceptional strength and may be used up to 1430° C. (2600° F.).

Interdigitate, as used herein, refers to the action of interlocking, coupling, connecting, interweaving, or commingling.

Interdigitatingly, as used herein, is the adverb that refers to the action of interlocking, coupling, connecting, interweaving, or commingling.

Interdigitation, as used herein, refers to the act of interlocking or the condition of being interlocked, coupled, connected, or interpenetrated, as is male-female coupling.

Intersection-spaces, intersecting-expansion-joint-spaces, as used herein, refers to expansion-joint-spaces that intersect into each other from different spatial orientations to form intersecting expansion-joint-spaces, also referred to more simply as "intersection-spaces," as opposed to a straight-line expansion joint space. In more detail, intersection-spaces are formed by the intersection of at least two expansion-joint spaces that each occur between different sets of two adjacent and spaced structural building units, each of said expansion-joint spaces defined by a plane, said plane defined by a set of three non-colinear points with each point defined by a set of x, y, z coordinates from the same coordinate system with no two of said coordinate sets being identical.

Intersection fire-barrier, as used herein, refers to any fire-barrier that is shaped to functionally fit into an intersecting-expansion-joint-space.

Intumescent as used herein, refers to those materials having properties that cause them to expand (or intumesce) to several times their original size when activated by high temperatures to prevent the spread of flames and smoke to other parts of a building, for example passive fire-seals contain intumescent compounds.

Laid-flat layer(s), as used herein, refers to layers that are laid flat one on top of another where there is no folding or pleating within any of the layers.

Male-Female Connections, as used herein, refers to connections in the mechanical and electrical trades and in manufacturing where each of a pair of mating connectors is conventionally assigned the designation male or female. The "female" connector, or female coupling-end, is generally a receptacle that connects to and holds the "male" connector, or male coupling-end, to provide for a coupling of two parts.

Metallic backing layer, as used herein, refers to fire-resistant (refractory) metal or metallicized foil, such as stainless steel, or the like.

Protective cloth, as used herein, refers to a flexible, strong, protective, refractory, woven material that is designed to mechanically support the insulation material and to protect the insulation material from mechanical damage, as the insulation is mechanically weak and can be easily damaged by tearing or ripping either accidentally or intentionally during or after installation thus largely compromising the integrity of the fire resistant barrier. Protective cloths may be woven from continuous filament amorphous silica yarns, polymeric material threads, fiber reinforced polymeric material threads, high-temperature resistant woven textiles, or a metalized, fiberglass cloth, among others. Metalized cloth may include fibers of stainless steel, aluminum, or copper, for example. Protective cloths also include refractory cloths that are woven to provide for shear, including lateral motion.

Structural unit, as used herein, refers to such constructs as a wall, floor, ceiling, or the like and may be referred to as building units.

Tri-dimensional, as used herein, refers to either an expansion joint that has three intersecting extension joint spaces, such as a T-shaped expansion joint intersection or to a fire-barrier that is functionally shaped to accommodate a T-shaped joint.

Woven Fabric is produced by weaving warp and weft yarns so that the warp yarns are oriented approximately 90 degrees to the weft yarns. There are voids between weft and warp yarns in the fabric so produced. This void volume is important in a variety of consumer and industrial applications including thermal insulation efficiency. Fibrous materials offer resistance to the transmission of heat because of the air enclosed between and on the surface of the fibers. Any fibrous, porous insulation material is adversely affected by the presence of moisture, whether this is perspiration or rain. Replacing air of low thermal conductivity by water of high conductivity is the primary cause. Moreover, fibrous materials, particularly pile fabrics or quilted battings, have a high affinity for wicking and entrapping large amounts of moisture.

A LIST OF THE REFERENCE NUMBERS AND RELATED PARTS OF THE INVENTION

F Female coupling-end.
M Male coupling-end.
2 Intumescent strip material.
4 Caulk.
6 Protective cloth.
8 Fire resistant sheet, metal foil, for example, adhered to 6.
10 A straight-line fire-barrier.
14 A first insulation blanket.
24 A second insulation blanket.
30 Inner L-bracket.
30*a* First leg of inner L-bracket 30.
30*b* Second leg of inner L-bracket 30.
32 Outer L-bracket.
32*a* First leg of outer L-bracket 32.
32*b* Second leg of outer L-bracket 32.
34 Third insulation blanket.
36 Attachment means for attaching fire-barrier to building unit 90 through L-bracket 30.
40*a* Pin fastener and friction-fit washer set providing for attachment of first insulation blanket 14 and second insulation blanket 24 to each other and to L-bracket 30*a*.
40*b* Pin fastener and friction-fit washer set providing for attachment of first insulation blanket 14 and second insulation blanket 24 to each other and to L-bracket 30*b*.
42*a* Friction-fit washer.
42*b* Friction-fit washer.
44*a* Friction fit washer.
44*b* Friction fit washer.

45*a* Pin fastener with friction-fit washer to provide means to detachably attach an installation tool to the fire-barrier.
45*b* Pin fastener with friction-fit washer to provide means to detachably attach an installation tool to the fire-barrier.
46 Spacer.
48 Friction fit washer.
50*a* Pin fastener with friction-fit washer providing for attachment of third insulation blanket 34 to L-bracket 30*a*.
50*b* Pin fastener with friction-fit washer providing for attachment of third insulation blanket 34 to L-bracket 30*b*.
52*a* Friction fit washer.
52*b* Friction fit washer.
53*a* Friction fit washer.
70 A horizontal L-shape corner intersecting fire-barrier with a male and a female coupling-end.
72 Metal channel.
73 Pins
75 A straight-line fire-barrier with male and female type coupling-ends.
90 A generic building unit.
90*a* First building unit.
90*b* Second building unit.
100 Installation tool.
102 Tool grasping means.
202 Pin attachment.
204 Aperture for connection to building unit.
206 Flange (L-bracket).
212 Washers on the pin.
214 Pin head.

DETAILED DESCRIPTION

Referring now to the drawings that show views of exemplary versions of the barriers and their related installation tools contemplated by this invention. The drawings also illustrate how the above discussed disadvantages have been overcome. It should be noted that the disclosed invention is disposed to versions in various sizes, such as lengths, widths, depths, in addition to variation in shapes, contents, layers, materials, and attachment means. Therefore, the versions described herein are provided with the understanding that the present disclosure is intended as illustrative and is not intended to limit the invention to the versions described.

FIG. 1, a cross-sectional view, illustrates an example of the various layers a fire-barrier made according to the principles of the present invention might have. The construction of all fire-barriers made according to the principles of the present invention requires all layers comprise refractory material and that while one or more layers may be attached to one or more other layers in the barrier, there is no instance where all of the layers are attached directly to each other at one particular point. This is essential, because if there were to be a contiguous opening, through the cloth layers, from one outer side of the barrier to the other outer side of the barrier, a route would be provided for the passage of fire, smoke, or gases. Thus, this exemplar multi-layered barrier consists of several full-length layers that are all of the same length. Having the cloth layers, including the refractory insulation blanket(s), refractory woven, protective cloth, and any refractory metal or metallic sheets included, the same length is important to keep the female/male connections gap free. In more detail, the various layers of a barrier may include protective cloth 6 forming the bottom or outside layer of the barrier, which is the side that faces the surfaces of the building units 90*a* and 90*b* making up the expansion joint space into which the barrier is installed and the space, itself. Protective cloth 6 is also the layer which will be in direct contact with a fire coming from lower floors. There are no metal layers covering the outside of protective cloth 6 as it is well known, as discussed above, that metal easily weakens in the heat of a fire and will burn. Positioned on the upper (inner) surface of protective cloth 6, in this example, is flexible fire-resistant support sheet 8 that could be a stainless steel foil sheet upon which is positioned first insulation blanket 14. Positioned on the upper surface of blanket 14 is second insulation blanket 24. Pin fastener 40*a* and friction-fit washer 42*a* provide for attachment of a first end of protective cloth 6, flexible stainless steel sheet 8, first insulation blanket 14 and a first end of second insulation blanket 24 to each other and to second leg 33*a* of L-bracket 30*a*. Pin fastener 40*b* and friction-fit washer 42*b* provide for attachment of a second end of protective cloth 6, flexible stainless steel sheet 8, first insulation blanket 14 and a second end of second insulation blanket 24 to each other and to and between second leg 32*b* of L-bracket 32 and second leg 30*b* of L-bracket 30. Positioned on the upper (inner) surface blanket 24 is third insulation blanket 34. Pin fastener 50*a* and friction-fit washer 52*a* provide for attachment of a first end of third insulation blanket 34 to second leg 30*b* of L-bracket 30. Pin fastener 50*b* and friction-fit washer 52*b* provide for attachment of a second end of third insulation blanket 34 to second leg 30*b* of L-bracket 30. Working together, the attachment set made up of pin 40*a* and friction-fit washer 42*a* and the attachment set made up of pin fastener 50*a* and friction-fit washer 52*a* provide for indirect attachment of one end of all of the layers to each other and to one set L-brackets 30 and 32. Similarly, the attachment set made up of pin fastener 40*b* and friction-fit washer 42*b* and the attachment set made up of pin fastener 50*b* and friction-fit washer 52*b* provide for indirect attachment of the other end of all of the layers to each other and to the other set of L-bracket 30 and 32. The attachment pin fasteners may be inserted into a select number of cloth and foil layers by either using the pins to pierce the cloth and foil layers, or by providing the cloth and foil layers with pre-formed apertures for the insertion of the pins. L-brackets are provided with pre-formed apertures for the insertion of the pins. It is important to note that the indirect attachment of the layers to each other and to the L-brackets ensures that there is no opening that penetrates through the entire structure. This provides another safeguard against leakage of smoke, fire, or gases through the barrier. This structure also provides added strength to the barrier. It should be understood that while the number of layers might increase or decrease, according to the principles of the present invention the layers are always attached to each other and to and between the L-brackets in a way that ensures that there are no gaps, that is, in this example there is never any one attachment that penetrates through all of the layers, including brackets. The attachment penetration is always indirect, regardless of the number of layers. Moreover, in the most critical parts of an installed barrier, that in the male/female connections of one unit to another, there are no attachments or attachment apertures that permeate the entire set of layers that form the connection. Attachment 36 provides for attachment of leg 32*a* of L-bracket 32 and of leg 30*a* of L-bracket 30 to building unit 90*a*. Another attachment means 36 provides for attachment of first leg 32*a* of L-bracket 32 and of leg 30*a* of L-bracket 30 to building unit 90*b*. If the contractor plans on using the installation tool of the present invention to install the barrier into its accepting expansion joint space, before the barrier is attached to upper L-bracket 30, pin fasteners 45*a* and 45*b* are inserted into a receiving aperture (not shown) from the bottom of the first legs 30*a* and 30*a* and brackets 30 to protrude entirely through and up out of the first legs of the L-brackets to provide attachment means for an installation tool that is discussed below. Attachment means 44*a* and 44*b*, which in this example are each a friction fit washer, hold pin fasteners 45*a* and 45*b* secure to the L-bracket.

Figure 2A:
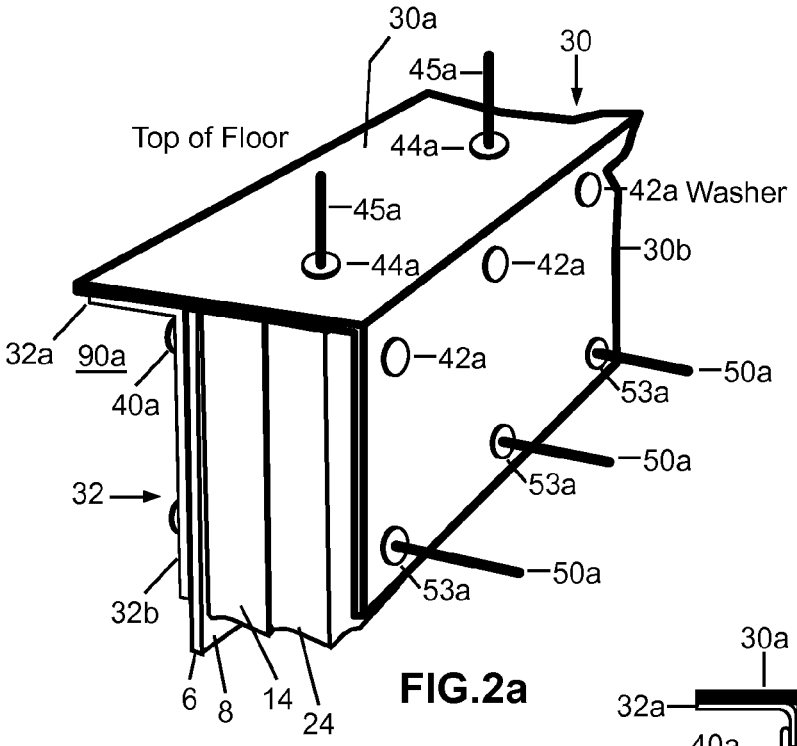
FIG. 2*a* is a perspective view of a partial section of the fire-barrier, as illustrated in FIG. 1.
Figure 2B:
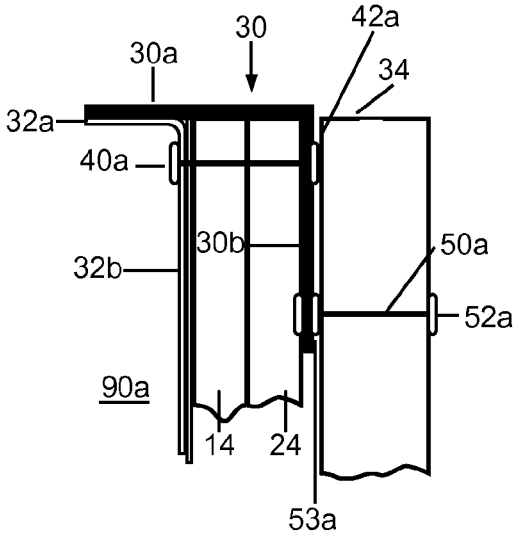
FIG. 2*b* is a side cross-sectional view of the partial section of the straight-line fire-barrier, as illustrated in FIG. 1, illustrating the addition of another layer of fire-barrier material.

FIG. 2*a*, a perspective view of a partial section of the fire-barrier illustrated in FIG. 1, more clearly illustrates how pin fastener 40*a* and friction-fit washer 42*a* may be used to provide for securing protective blanket 6, metallic sheet 8, and two insulation blankets 14 and 24 to each other and to and between second leg 30*b* of L-bracket 30 and leg 32*b* of L-bracket 32. Pin fasteners 50*a* with washers 53*a* are seen protruding through and extending some distance from the surface of second leg 30*b* of L-bracket 30. FIG. 2*b* illustrates how pin fasteners 50*a* with washers 53*a* are used in conjunction with friction-fit washer 52*a* to attach third insulation blanket 34 to second leg 30*b* of L-bracket 30. Pins 45*a* and washer 44*a* project from leg 30*a* of L-bracket 30 to provide attachment means for an installation tool when the barrier is ready to be installed. The double thickness of leg 30*a* of L-bracket 30 and leg 32*a* of L-bracket 32 will be used to attach the barrier to building unit 90*a*. If the installation tool of the present invention is to be used to install the fire-barrier, pins 45*a* are inserted into and through first leg 30*a* of L-bracket 30 before it is attached to the barrier, so that a length of the pin protrudes upwards from the outer surface of first leg 30*a* to extend some distance from that outer surface to provide for attachment of an installation tool to the barrier for installation of the barrier into a joint space. It should be understood that the number of layers required by the fire-barriers manufactured according to the principles of the present invention is not limited by this, or any other, example given herein. The number of layers required per fire-barrier is determined by many factors, such as the composition and thickness of the material comprising each layer, the width and depth of the expansion space into which the barrier is to be installed, and the degree of fire-protection that is specified for the building. Again, depending on such factors as the thickness of the various material layers, the total barrier thickness, and the composition of the layers, various other configurations of pins and washers may be utilized and various distances between the attachment means may be employed without departing from the scope of the invention.

Figure 3:
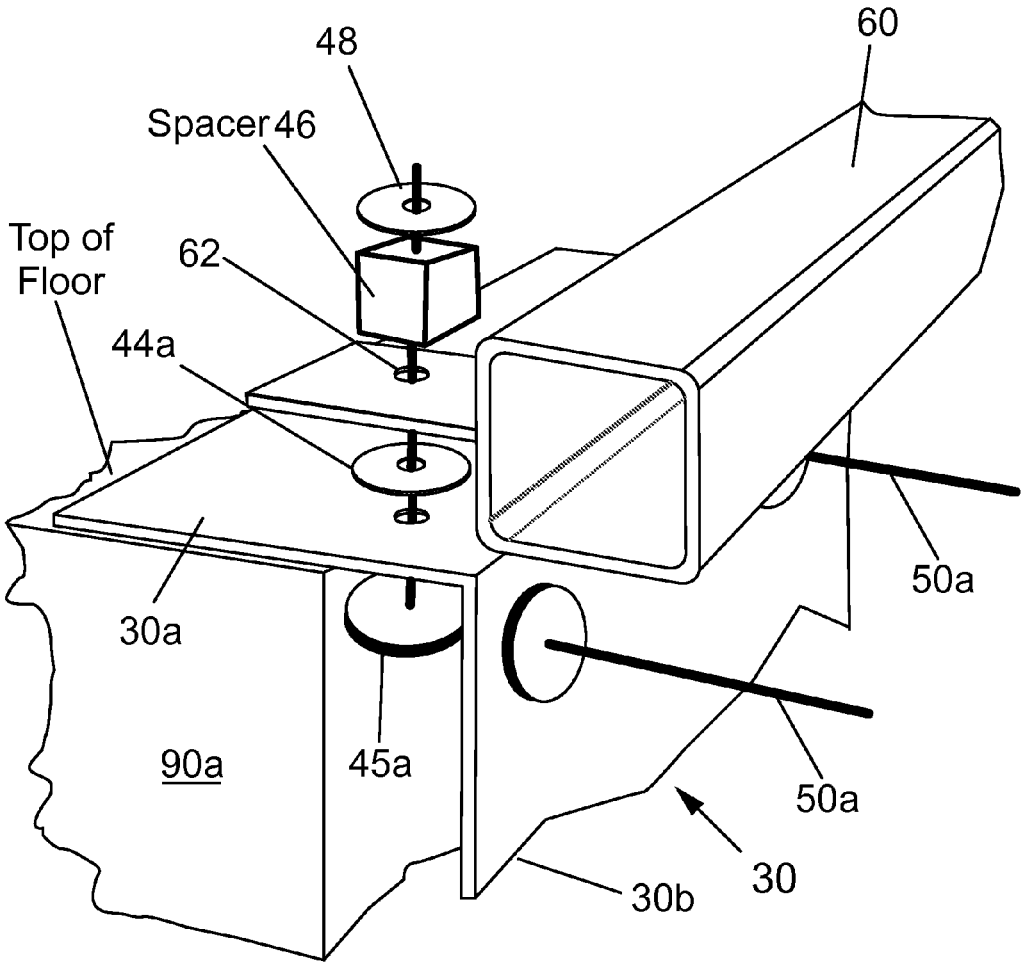
FIG. 3 is an exploded perspective view of a partial section of the L-bracket to illustrate an example of attachment means that may be used to attach an installation tool to the L-bracket.

FIG. 3, is an exploded perspective view of a partial section of an L-bracket partially overlaying building unit 90*a* to more clearly illustrate an example of one of the installation tool attachment devices of the present invention that may be used to install the pre-assembled fire-barrier in either a straight-line expansion joint space or an intersection-space. To temporarily, but securely, attach an installation tool to the fire-barrier for installation purposes, one part of an installation tool is attached to one of the L-brackets of a barrier and another part of the tool is attached to the complementary L-bracket of the fire-barrier. To do this, there must be some preparation before the barrier is fully assembled. That is, when an installation tool is to be used to install the barrier, before the barrier is attached to its L-brackets 30, a pin, such as pin 45*a*, is inserted through leg 30*a* of each L-bracket 30. The pin is held in place by friction fit washer 44*a*. When the fire-barrier's construction is complete, installation tool 60 is temporarily attached to leg 30*a* of L-bracket 30 by inserting pin 45*a* through aperture 62 of a connecting plate of installation tool 60. Spacer 46 is placed over pin 45*a* so that it rests on the outer surface of the connecting plate of installation tool 60. Spacer 46 ensures the space needed when it is time to cut pin 45*a* for the removal of the installation tool from the fire-barrier. Friction fit washer 48 is positioned over pin 45*a* to rest on spacer 46 to secure attachment of the tool to the barrier. When the installation tool is no longer needed, it is easily and rapidly removed from the fire-barrier by cutting through pin 45*a*, thus breaking the connection between the fire-barrier and the installation tool. If the installation tool is not to be used in the installation of the barrier, this step is skipped.

Figure 4:
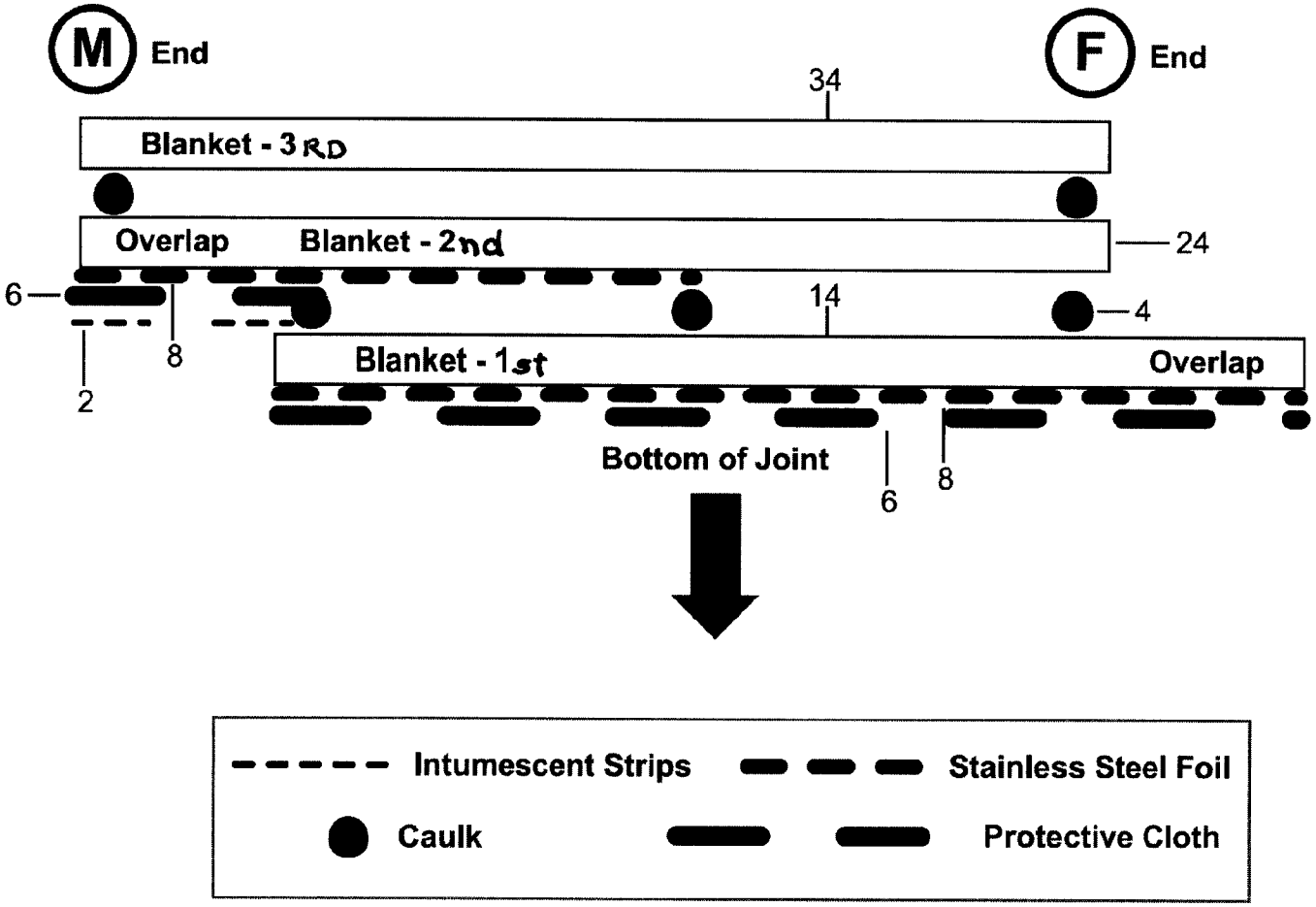
FIG. 4 is a cross-sectional cartoon of the straight-line fire-barrier, as illustrated in FIG. 1, to more clearly illustrate the layer construction of the straight-line barrier having one male coupling-end and one female coupling-end.

FIG. 4 is a cross-sectional cartoon view of a fire-barrier to more clearly illustrate the female end and male end construction of a layered barrier. Each layered barrier comprises two sets of various refractory materials. For the sake of clarity, L-brackets are removed from this view. The male and female coupling-ends of the barrier are made by the off-set positioning of various sets of layers of the fire-barrier. The male/female construction depends only on the off-set positioning of the two set of layers. There is not folding or bending of one layer over another layer or set of layers. All of the full-length layers or sheets, as shown in this example and as mentioned with respect to the barrier shown in FIG. 1, are of the same length and include in at least one set an outer layer of protective cloth, a layer of metal foil, and one or more layers of insulation blanket. Offsetting stacks (sets), each contain some number of full-length layers. Offsetting one stack from the other provides for tightly sealable projecting male ends and receiving female ends. In this example, the first set of refractory layers, that is the set containing blanket $1^{st}$ (also denoted 14), is made up of a bottom or outer layer of full-length protective cloth 6, on the top (inner) surface of protective cloth 6 is positioned fire resistant layer 8, which in this example is a flexible stainless steel foil, but could be any desired fire resistant supporting material. As mentioned, full-length protective cloth 6 and fire resistant layer 8 are cut to the same length. Thus, each of these two layers extends the length of its adjacent layer and cannot extend past the ends of its adjacent layer. This means that there is no extension of one full-length layer of to be folded over the end surfaces of the other full-length layer. This is done to prevent gaps from forming by the folding up, or down, of one layer, such as the protective cloth, about the other layer, such as an insulation blanket, to cover the ends of its adjacent layer, or layers. When a cloth, as thick and as stiff of a protective cloth is folded about another layer, there is a gap formed between the protective cloth and the layer about which it is folded. This happens because protective cloth is too stiff to be fitted tightly into a corner space. Such gaps provide for penetration of fire, smoke, and gases into and through the barrier, which is exactly what fire-barriers are meant to prevent. Additionally, such a gap would almost certainly cause the barrier to fail the fire test it is mandated to pass before it can be used for its intended purpose. In this illustration, fire resistant sheet 8 is attached to the upper (inner) surface of protective cloth 6 using adhesive. The method of attachment is dictated by the needs of the user of the fire-barrier. In addition to adhesive, the fire resistant sheet may be attached to the protective by sewing, stapling, bolting, or any other known or yet to be known means for attaching the two sheets. Alternatively, if desired, the two sheets do not have to be attached before installation. The next full-length layer of the first set comprises insulation blanket $1^{st}$ positioned on the upper surface of layer 8, which as seen from FIG. 4 has the same length as layers 6 and 8. To form the male/female connecting ends, a second set of layers is constructed. This is accomplished by first positioning a full-length insulation blanket $2^{nd}$ (also denoted as 24) on the upper surface of blanket $1^{st}$ in an offset manner. In this example, caulking 4 is applied between insulation blanket $1^{st}$ and insulation blanket $2^{nd}$ for seamless and air-tight attachment of the two insulation blankets to each other to ensure that there is no possible way for fire, smoke, or gas to penetrate through the barrier. In this example, insulation blanket $2^{nd}$ is overlain by full-length insulation blanket $3^{rd}$ (also denoted 34). Caulking 4 also may be used between insulation blanket $2^{nd}$ and insulation blanket $3^{rd}$. At this point the male and female ends are shaped. To complete the construction, on the exposed under-surface of the overlapped male end M of blanket $2^{nd}$ a non-full-length of metal foil 8 is attached to the exposed end of blanket $2^{nd}$ To protect the exposed metal foil 8, it is covered by non-full-length layer of protective cloth 6 with the exposed edges of cloth 6 lined with intumescent strips 2. In the embodiment illustrated, the intumescent strip is attached to protective cloth 6 using staples, it is, however, to be understood that stapling is not a required attachment means, as the attachment is just as well accomplished using pins, caulking, sewing or any other known or yet to be know means for attaching two such sheets. Note that neither full-length or non-full-length layers extend beyond the end of any of the other layers and that there is no folding of one layer over another, and that there is not metallic layer exposed to the heat and flames of a fire. This offset positioning of blankets $2^{nd}$ and $3^{rd}$ over blanket $1^{st}$ provides for the barrier to have female F receiving or accepting end and male projecting end M. During installation the male end of one barrier is simply, quickly fitted onto, that is, "interdigitated with," the female end of a second barrier, which provides for precise, custom-contoured, snug overlapping coupling of the male end and the female end requiring no on-site splicing operations. Caulking is used to provide an extra level of security for the attachment of the male and female ends. Other means for securing the attachment, such as adhesive or staples, among others may be used, if desired.

Figure 5:
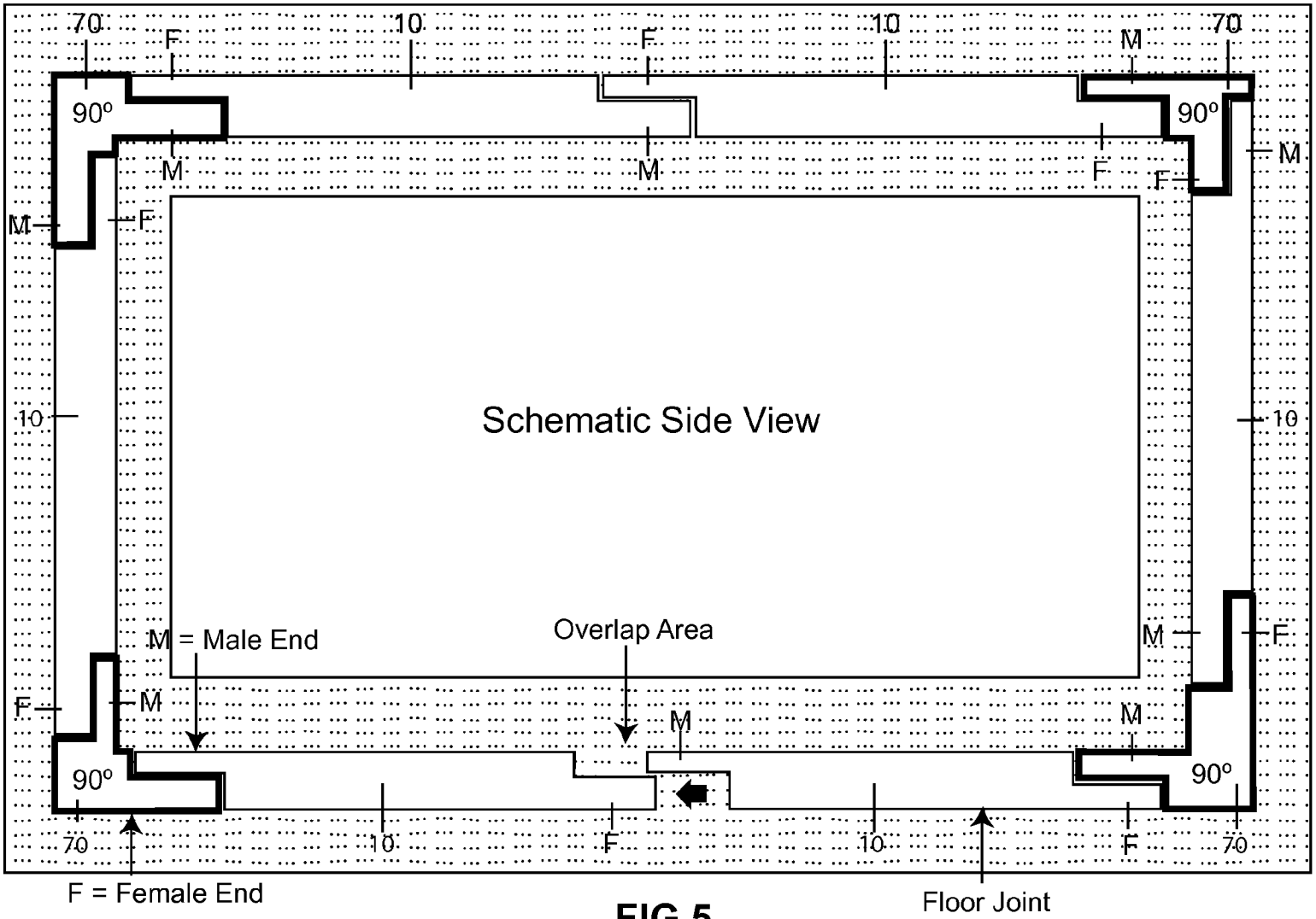
FIG. 5 is a top plan view to illustrate how straight-line fire-barriers having one male coupling-end and one female coupling-end interdigitate with each other to provide a complete fire-barrier system with no on-site fire-barrier construction or trimming required.

FIG. 5, a schematic, top plan view, is presented to illustrate how straight-line barriers 10 having male/female type coupling-end structures, M and F referred to as overlap areas of the fire-barriers in the drawing, couple with adjacent straight-line barriers 10, and with the horizontal/horizontal-armed, 90° corner intersection-space fire-barriers 70 that also having mating male/female type coupling-ends, M and F. It should be noted that in FIG. 5 the coupling is shown in a sideways orientation to show the coupling, this is done so that the coupling for an entire room may be understood using only one figure. It should also be noted in FIG. 5 that for each pair of straight-line fire-barriers that have coupling straight-line barriers, there is a space between the two fire-barriers coupled to each other that does not exist is reality. This space is provided only to accentuate the male/female coupling of the barriers. In fact, when fire-barriers are constructed according to the principles of the present invention, all potential for space or openings within the coupling areas is eliminated. Thus, looking at FIG. 5 it is obvious how easily and rapidly a fire-barrier system of the present invention may be installed in the expansion-joint-spaces about an entire perimeter of a room without requiring any on-site construction or trimming. This significantly reduces the time and person power required for installation, thus not only reducing the cost of the fire-barrier and its installation, but also decreasing risk to workers by decreasing, if not eliminating, respirable particles in the working atmosphere and reducing the danger to workers of being cut by the sharp edged metal foil that is frequently used in the construction of the fire-barriers. Accordingly, as worker safety is increased by the pre-assembled, one piece barriers and their over-lapping coupling-ends, the cost of fire hazard and worker's compensation insurance should be reduced.

Figure 6:
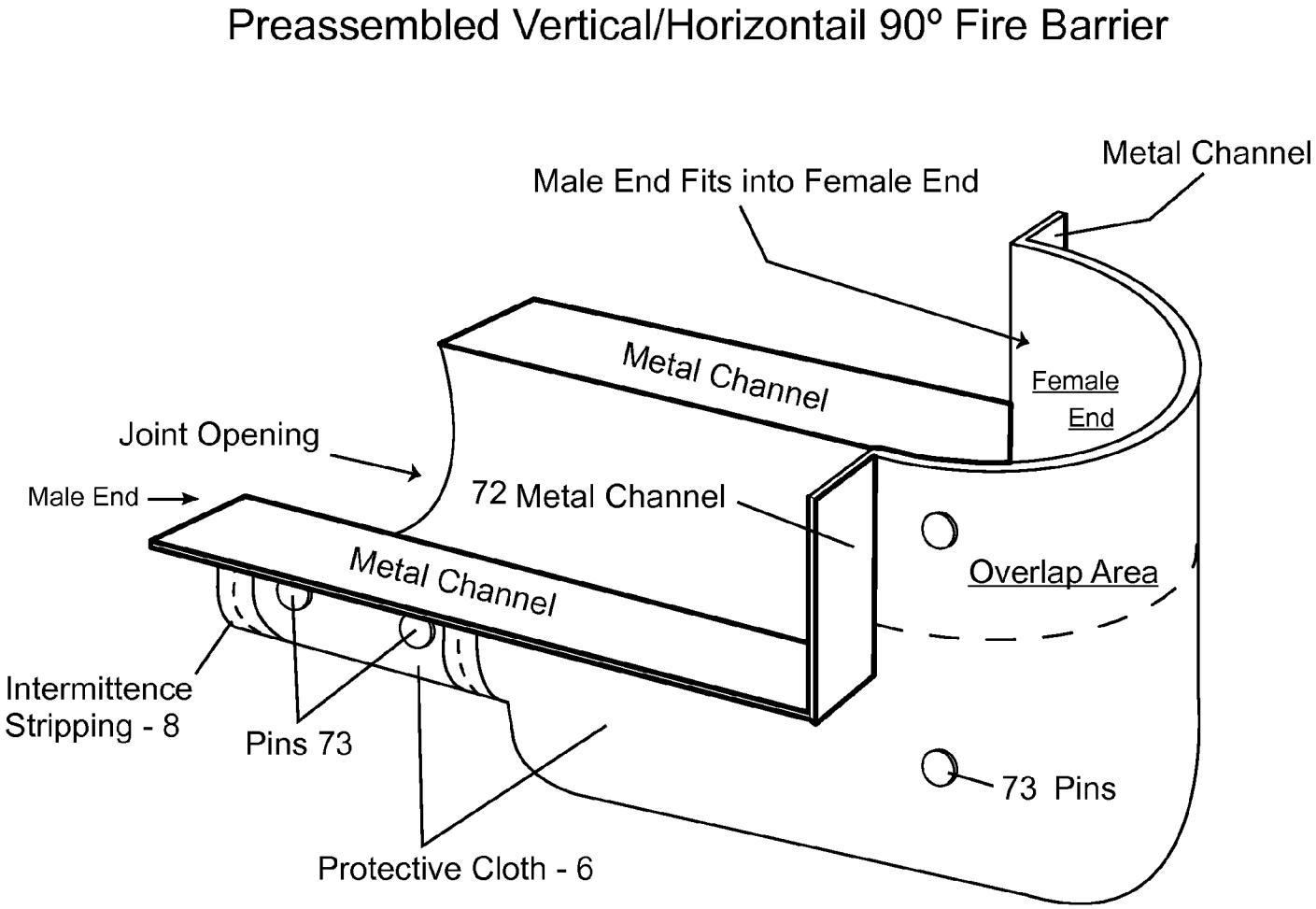
FIG. 6 is a perspective cartoon view of a horizontal/vertical, 90° L-shaped fire-barrier with one male and one female end, for interdigitated coupling with, for example the complementary ends of an abutting straight-line fire-barrier illustrated in FIG. 7.

FIG. 6, a perspective view, illustrates a horizontal/vertical, L-shaped, 90° corner intersection fire-barrier with a male M and a female F coupling-end. This barrier, as are all the barriers of the present invention, is provided to the job site as a pre-assembled, one-piece unit designed according to specification and ready for one-step, drop-in installation. The drawing shown in FIG. 6 demonstrates how this particular barrier, and, in fact, how any corner barrier having two coupling-ends, is constructed with a male end and a female end for connection with, for example, a straight-line barrier. The male coupling-end, as illustrated in FIG. 6, could be interdigitated with the female coupling-end of the straight-line fire-barrier, such as the one, illustrated in FIG. 7. Alternatively, the female coupling-end, as illustrated in FIG. 6, could be interdigitated with the male coupling-end of the straight-line fire-barrier illustrated in FIG. 7. Of course, if required, all styles of coupling-ended barriers may be provided with both ends being male coupling-ends or both ends being female coupling-ends, if required. The same end design flexibility is available on all the barriers including the more geometrically complex barriers, such as T-shaped and cross-shaped barriers. In the example illustrated in FIG. 6, only protective cloth 6 with attached intumescent stripping 2, fire resistant metal flange channels 72, and pins 73 that provide means for attaching the barrier layers to each other are shown.

Figure 7:
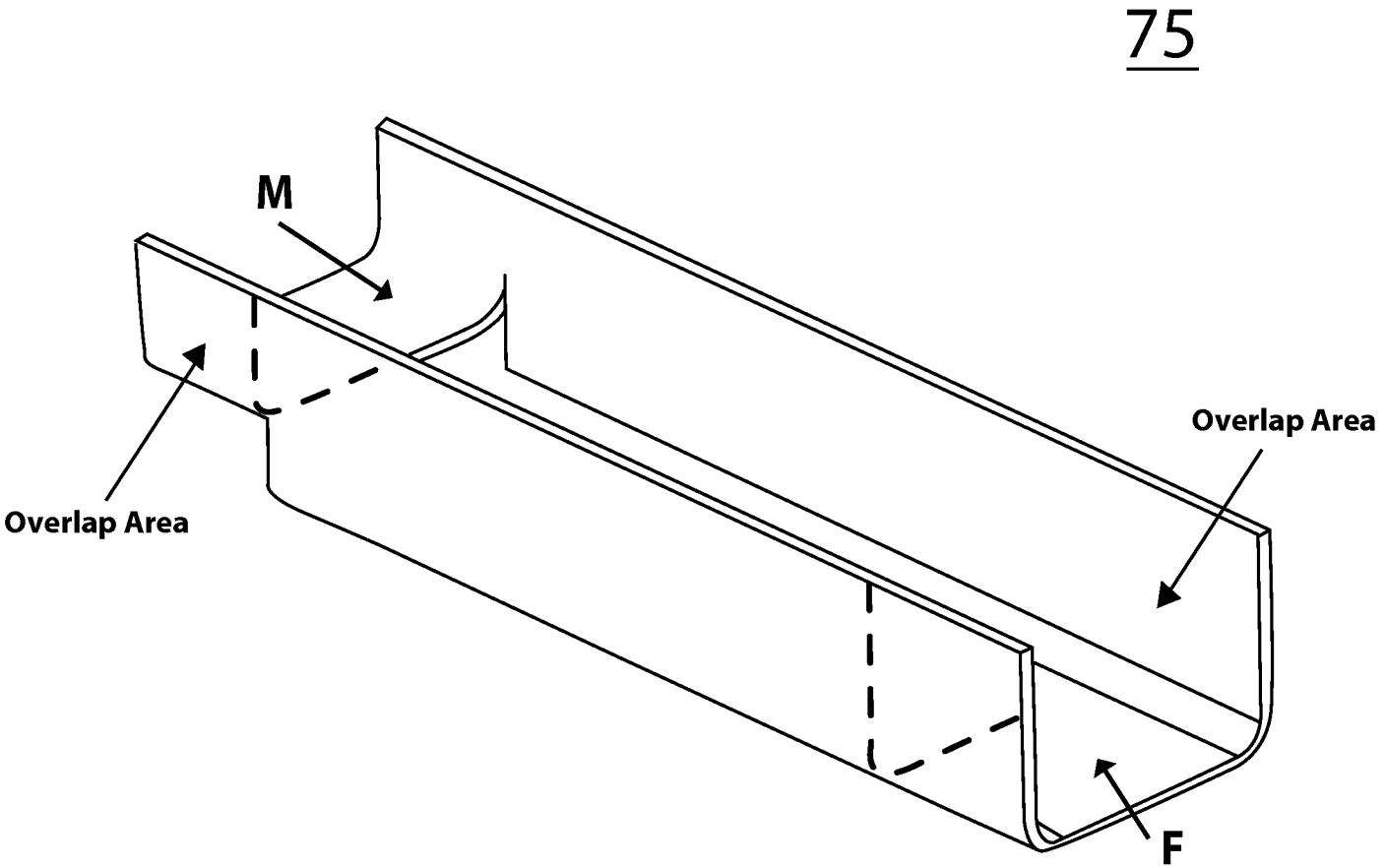
FIG. 7 is a perspective view of a straight-line fire-barrier with a male and female coupling-end for coupling this barrier, for example, with the horizontal/vertical, 90° L-shaped fire-barrier, as illustrated in FIG. 6.

FIG. 7, a perspective view, illustrates straight-line fire-barrier 75 with a male M coupling-end and a female F coupling-end according to the principles of the present invention. The female and male coupling-ends are to be interdigitated with accepting male or female coupling-ends of adjacent barriers.

Figure 8:
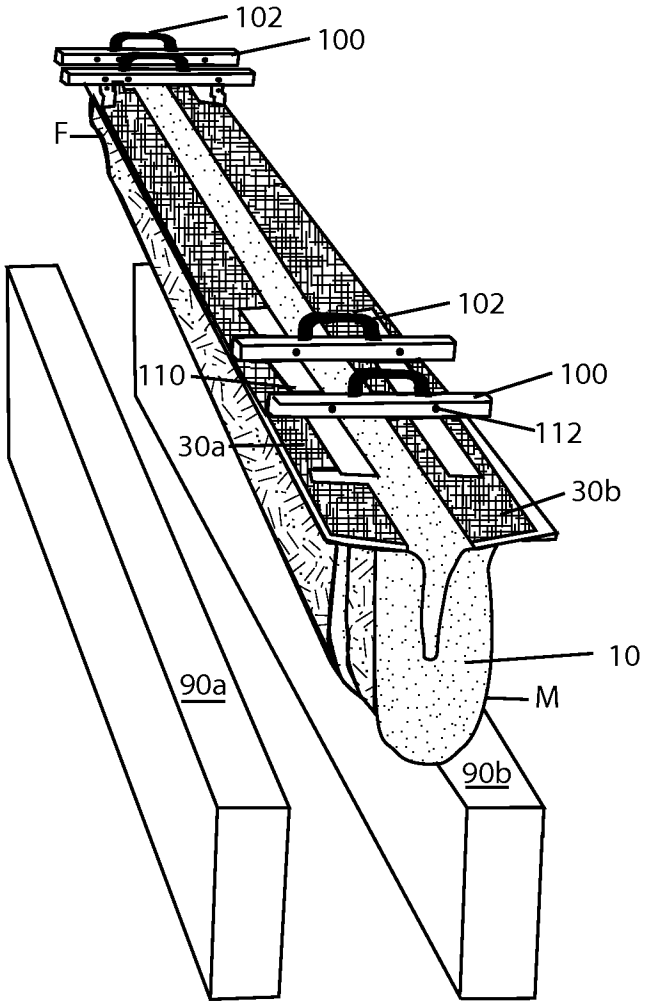
FIG. 8 is a perspective view illustrating how the installation tool of the present invention provides for easy the drop-in installation of a ten foot section of the straight-line fire-barrier.

FIG. 8 shows exemplary straight-line fire-barrier 10 with two installation tools 100 detachably attached, one to each end of the barrier. The frame of each tool is constructed of a set of two elongate strips 110 of a sturdy and light-weight material, such as aluminum or plastic, with the long axis of the strips oriented in the same direction as the long axis of the barrier to which they is attached and arranged parallel to and spaced from one another, and a second set of two elongate strips 100 arranged parallel to and spaced from one another and positioned over the second set of strips so that strips 110 for an approximately 90 degree angle whit strips 100. Thus, the two sets form a construct similar to a number sign "#" but where the angles between all crossing strips are all at approximately right angles. The lower set of strips each have means for being detachably attached to the fire-barrier, as was explained above. The upper set of strips has a grasping means, such as handle 102 for easy lifting of the tool and the barrier to which it is connected. FIG. 8 shows how the installation tool just described provides for easy one-step, drop-in installation of a ten foot section of the straight-line fire-barrier.

The structural configuration of a tool may vary considerably without departing from the spirit of the invention to provide for tools that provide for easy, one-step, lifting, and installing of a fire-barrier of any of the shapes that are possible following the principles of the present invention. The tool may be piece constructed or may be molded. There are as many tool styles as there are differently shaped fire-barriers, so that the tool fits over each of variously shaped barriers, such as the T-shaped installation tool that is shaped for installing a T-shaped intersection fire-barrier.

Figure 9:
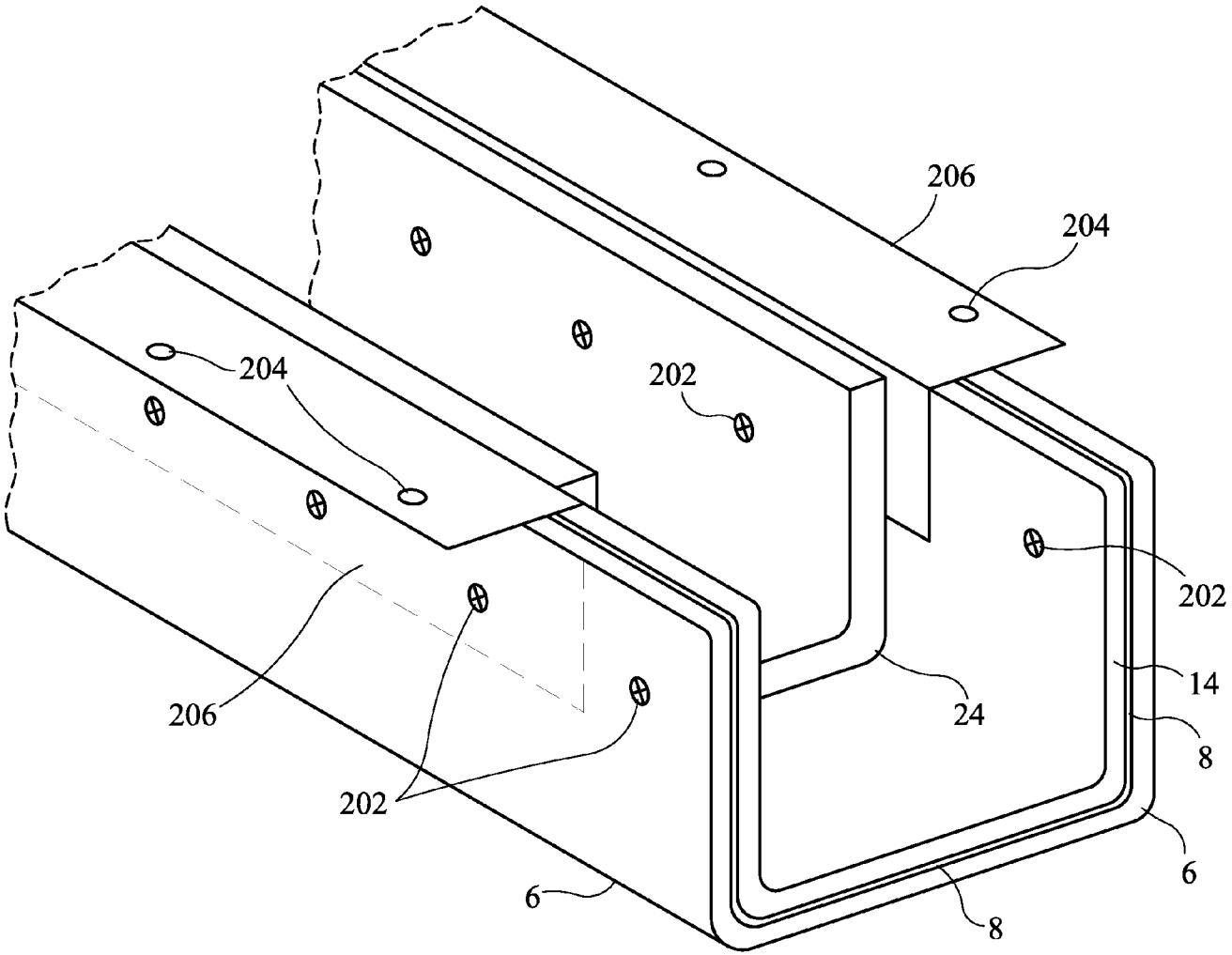
FIG. 9 is a perspective view of a female coupling-end of a fire-barrier.
Figure 10:
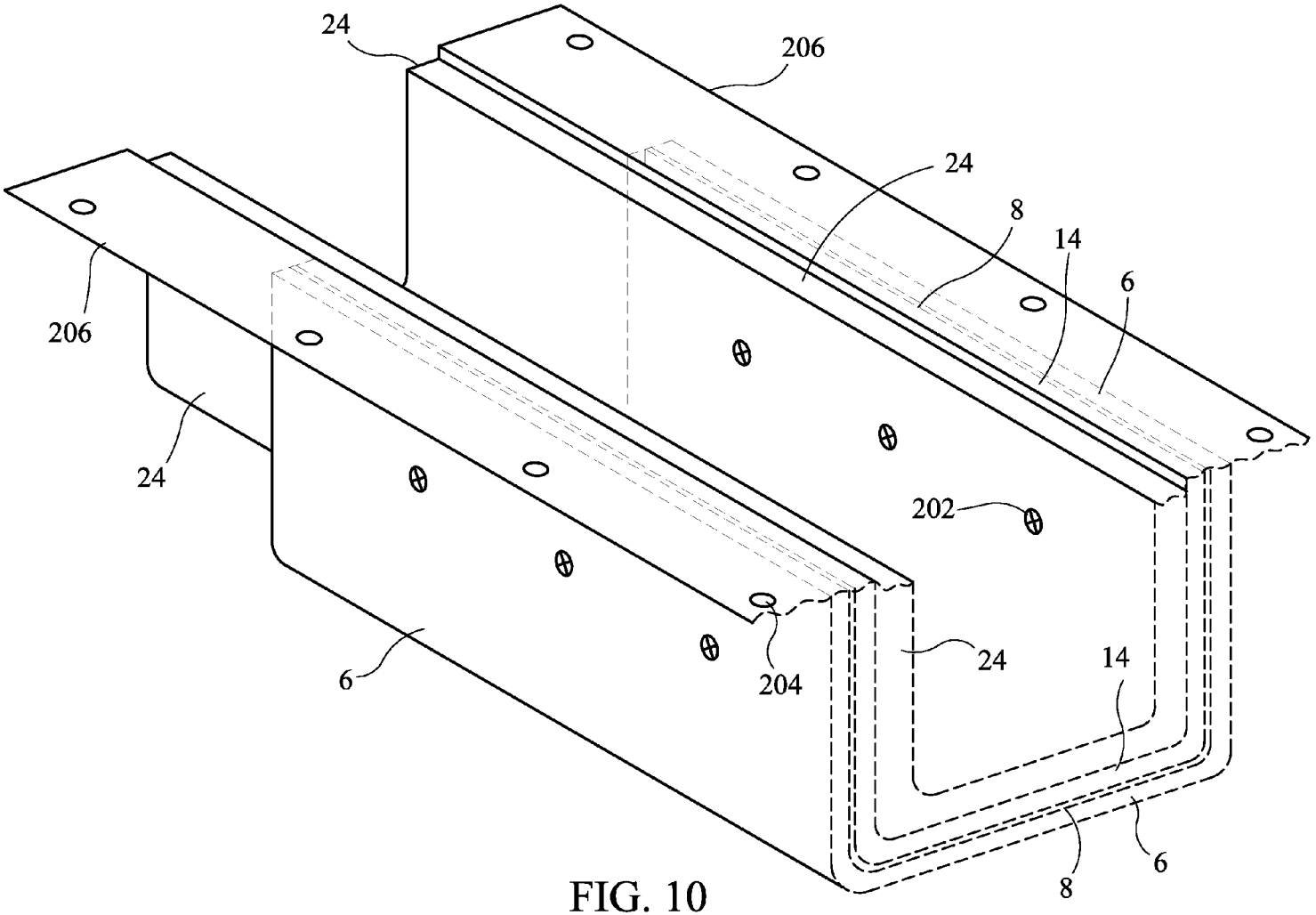
FIG. 10 is a perspective view of a male coupling-end of a fire-barrier.

FIG. 9 is a perspective close-up view of a female coupling-end of a fire-barrier. This example shows a fire-barrier comprising two sets of fire-barrier material (analogous to cartoon drawing of a barrier as seen in the FIG. 4, except that the barrier in FIG. 9 omits insulation blanket layer 34). Note that the number of insulation blanket layers may be varied, as discussed above. In this example, the set of layers containing what will be referred to as a "first set" comprises full-length protective cloth 6 as the bottom or outside layer that is the layer that will be directly exposed to the flames, heat, and gases of a fire from a lower floor, on the top of, that is on the inner surface, of protective cloth 6 is positioned, in this example, full-length stainless steel foil layer 8. In this illustration, fire resistant sheet 8 is attached to the upper (inner) surface of protective cloth 6 using adhesive. The method of attachment is dictated by the needs of the user of the fire-barrier. In addition to adhesive, the fire resistant sheet may be attached to the protective by sewing, stapling, bolting, or any other known or yet to be known means for attaching the two sheets. Alternatively, if desired, the two sheets do not have to be attached before installation. The next full-length layer, positioned on the upper surface of layer 8, is a full-length of insulation blanket 14, being of the same length as layers 6 and 8. In this example, protective cloth 6, full-length stainless steel foil layer 8, and insulation blanket 14 are attached using attachment means, such as pins 202. The next step is to positions flanges 206 over the top edges and sides of each opposite arm of the U-shaped barrier. These flanges will be used to mount the barrier to building units using attachments means, for example, bolts or the like, using attachment apertures 204. The next step is to form the male/female connecting ends by positioning another layer of insulation blanket 24 over the upper surface of blanket 14 in an offset manner as illustrated in FIG. 9. The offset positioning of blanket 24 over blanket 14 provides for the barrier to have a female, receiving end (as illustrated in FIG. 9) and a male projecting end (as illustrated in FIG. 10). In this example, pins 202 are being used to attach insulation blanket 24 to the other layers. Alternatively or additionally, caulking could be applied between insulation blanket 14 and insulation blanket 24 for seamless attachment of the two insulation blankets to each other to ensure that there is no possible way for fire, smoke, or gas to penetrate through the barrier.

FIG. 10 is a perspective close-up view of a male coupling-end of a fire-barrier. To complete the construction (as described in the text relating to FIG. 4 but not shown in FIG. 9) a non-full-length of metal foil 8 is attached to the exposed under-surface of blanket 24 and to protect the exposed bottom surface of metal foil 8 a non-full-length layer of protective cloth 6 is attached with the exposed edges of protective cloth 6 lined with intumescent strips 2 (as shown in FIG. 4). Thus, it is easy to appreciate that there is no layer of protective cloth material 6 that can be placed or folded over the end surfaces of another layer as in other's barriers. This design, according to the principles of the present invention, prevents gaps from forming by the folding up, or down, of one layer, such as is seen with the protective cloth of other's barrier, about another to cover the ends of its adjacent layer, or layers. Such gaps are clearly seen in barriers that use an elongated protective cloth. As mentioned, protective cloths are stiff so that when it is positioned to cover off-set layers, a gap is formed between the protective cloth and the layer about which it is folded. This happens because protective cloth is too stiff to be fitted tightly into a corner space. Such gaps provide for penetration of fire, smoke, and gases into and through the barrier, which is exactly what fire-barriers are meant to prevent. Additionally, such a gap would cause the barrier to fail the fire test it is mandated to pass before it can be used for its intended purpose. During installation of the completely manufactured barriers to building units, the male end of one barrier is simply, quickly fitted onto, "interdigitated with," the female end of a second barrier providing for precise, custom-contoured, snug overlapping coupling of the male end and the female end requiring no on-site splicing operations. Caulking is used to provide an extra level of security for the attachment of the male and female ends. Other means for securing the attachment, such as adhesive or staples, among others may be used, if desired. During installation of the completely manufactured barriers to building units, the male end of one barrier is simply, quickly fitted onto, "interdigitated with," the female end of a second barrier providing for precise, custom-contoured, snug overlapping coupling of the male end and the female end requiring no on-site splicing operations. Caulking is used to provide an extra level of security for the attachment of the male and female ends. Other means for securing the attachment, such as adhesive or staples, among others may be used, if desired.

Figure 11:
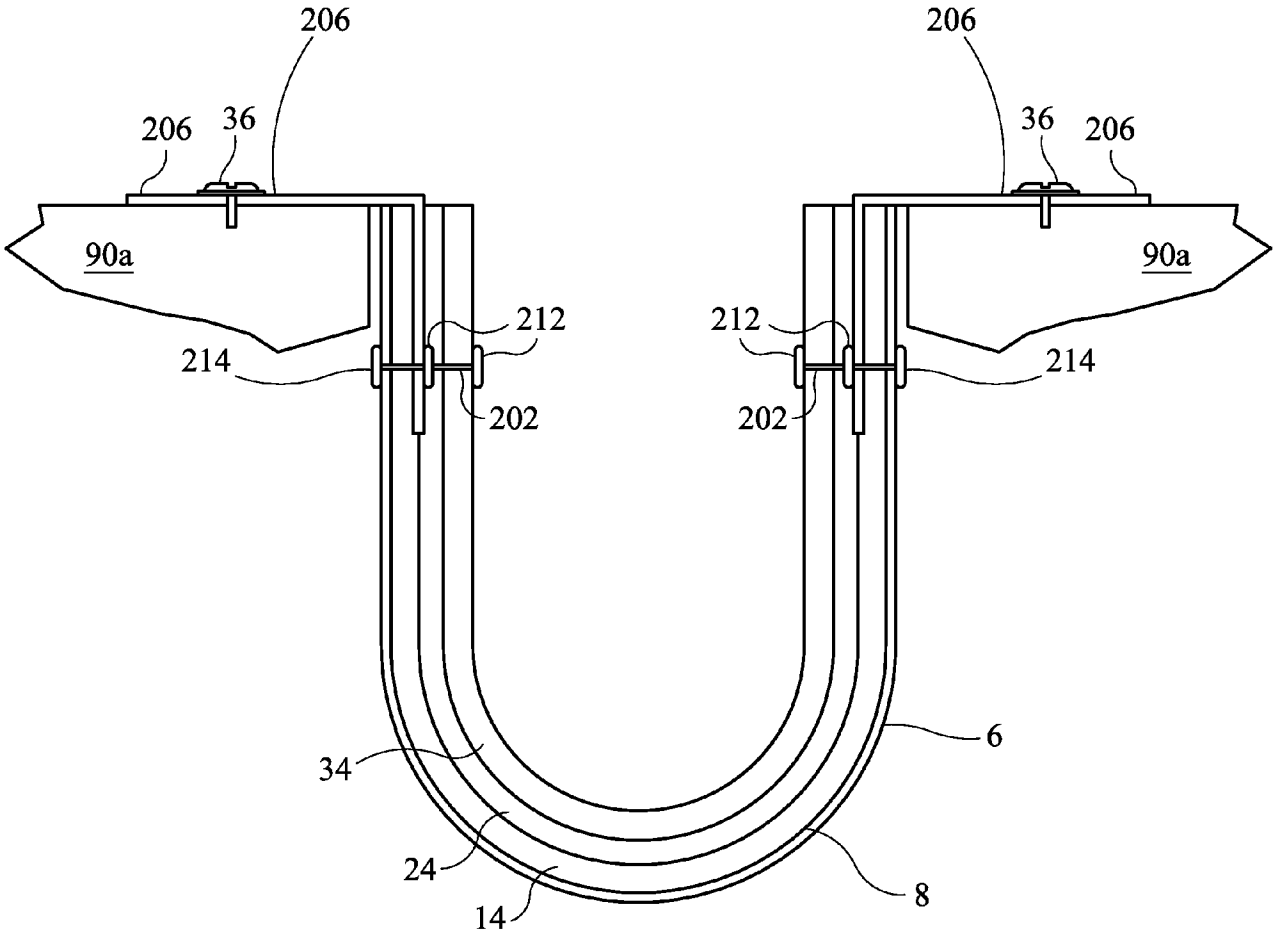
FIG. 11 is a cross-section view of an installed section of a fire-barrier of the present invention.

FIG. 11, a cross-section view, illustrates the construction of a central, that is, not of either the male or female sections, portion of an installed fire-barrier of the present invention. Illustrated is a "top-mount" barrier, but it is to be understood that male and female end construction is standard on all of the fire barriers invented by the present inventor, including side-mount, bottom-mount, wall-mount, and moisture impermeable. The outer exposed, or bottom layer, (sheet) of this barrier is protective cloth 6, overlain, in this example, by flexible fire-resistant support sheet 8 that could be a stainless steel foil sheet, which in turn is overlain by first insulation blanket 14 overlain by second insulation blanket 24 which is overlain by third insulation blanket 34. A first L-bracket 206 is illustrated having its one leg attached to one building unit 90*a* and the other leg between and attached to first insulation blanket 14 and second insulation blanket 24. A second L-bracket 206 is illustrated having its one leg attached to opposing building unit 90*a* and its other leg between and attached to first insulation blanket 14 and second insulation blanket 24. A first pin fastener 202, with pin head 214, is shown attaching an upper one side portion of cloth 6, support sheet 8, and first insulation blanket 14 to the first L-bracket 206. A washer 212 secures cloth 6, support sheet 8, and first insulation blanket 14 to the first L-bracket 206. First pin fastener 202 continues through second insulation blanket 24 and third insulation blanket 34 and is secured in place by another washer 202. Likewise, on the opposing side of the barrier, second pin fastener 202, with pin head 214, is shown attaching the opposing upper side portion of cloth 6, support sheet 8, and first insulation blanket 14 to the second L-bracket 206. Yet another washer 212 secures cloth 6, support sheet 8, and first insulation blanket 14 to the second L-bracket 206. Second pin fastener 202 continues through second insulation blanket 24 and third insulation blanket 34 and is secured in place by another washer 202. Thus, it is shown that even in this attachment design, there is no direct connection of any of the cloth or metal foil layers to all of the others. There is always an extra support and precaution between the layers, in this case it is L-bracket 206 that provides the extra support and precaution by preventing the complete set layers from being directly attached one to another. Attachments 36 provide for attachment of the leg of the first L-bracket 206 and the leg of the first L-bracket 206 to opposing building units 90*a*. It should be understood that while the number of layers might increase or decrease, according to the principles of the present invention the layers are always attached to each other and to the L-brackets in a way that ensures that there are no gaps. Moreover, in the most critical parts of an installed barrier, that is, in the male/female connections of one unit barrier to another, there are no attachments or attachment apertures that permeate the entire set of layers that form the connection.

Figure 12:
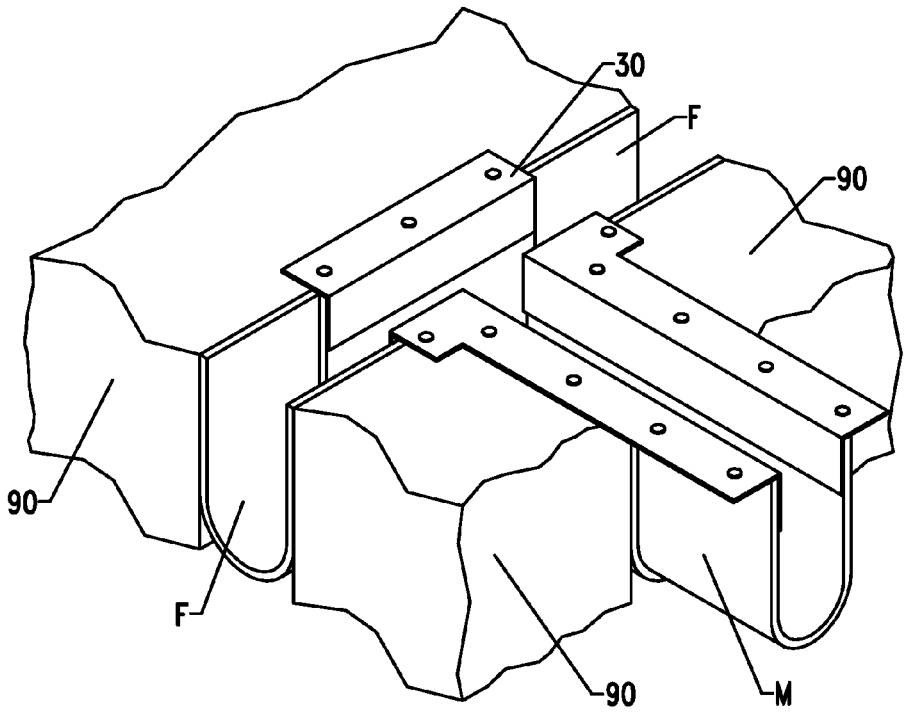
FIG. 12 is a perspective view of an installed t-shaped fire-barrier of the present invention.
Figure 13:
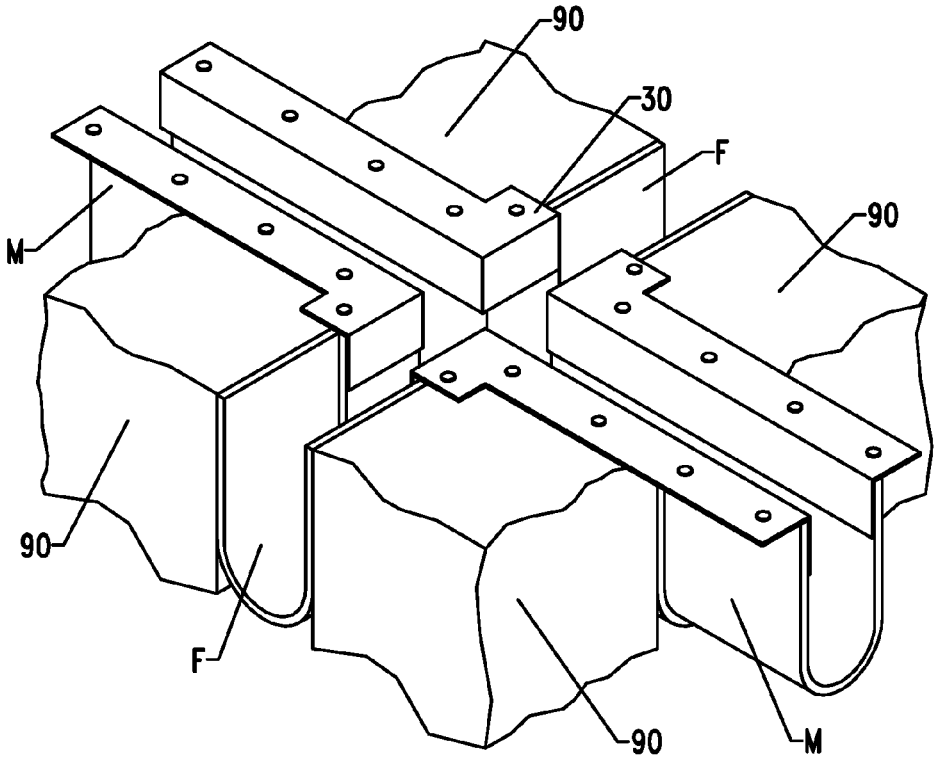
FIG. 13 is a perspective view of an installed cross-shaped fire-barrier of the present invention.

Thus it has been shown that the present invention comprises male and female ended intersecting and straight-line fire-barriers. There is shown in FIG. 12 a t-shaped barrier that is styled to fit a t-shaped expansion joint and in FIG. 13 a cross-shaped barrier that is styled to fit a cross-shaped expansion joint. In FIG. 12 and FIG. 13 subsequent insulation blanket layers are not shown. The male and female ended barriers provide for easy and rapid coupling of the straight-line barriers with straight-line barriers, straight-line barriers with intersecting barriers, and intersecting barriers with intersecting barriers providing rapid, safe installation of the barriers while requiring no on-site cutting or construction; that all of the variously styled barriers are constructed as pre-assembled single-piece male/female coupling-ended units for use in intersecting and straight architectural expansion-joint-spaces to prevent the migration of gases, flame, and smoke through a structure; and that each style barrier is provided with a one-step, one-person, drop-in, reusable, width adjustable installation tool. The barriers of the present invention do not have an exposed metal or metallic layer, that is, there is no metal layer that is directly exposed to the flames or heat of a fire ascending from a lower floor. There is no layer of material, such as protective cloth that extends out past another layer so as to have the protective cloth folded over and covering the stepped or overlapping layers, thus preventing gaps being formed by the folded over material. In the barriers of the present invention, one layer of refractory material is laid-flat against its adjacent layer. In fact, there are only flat layers adjacent to flat layers, there is no folding or pleating with a layer. There are no attachments, such as wires, staples, pins, or bolts, or attachment apertures that permeate the entire set of layers that form the male and female connections.

What is claimed is:

1. A fire-barrier for installation into an expansion-space between building units, comprising:

a plurality of layers, each layer comprising,
at least one protective blanket sheet (6) underlying
at least one insulation blanket sheet (14, 24), and
at least one foil sheet (8), said sheets stacked forming a multi-sheet layer where said sheets are parallel to one another along their length;

said plurality of layers superimposed and longitudinally offset such that ends of the plurality of layers are not aligned to cause said fire-barrier to have coupling ends that are male, female, or a combination of both, one of said layers being a bottom layer, none of the sheets folded or bent over an end of another of said sheets preventing the formation of gaps between said sheets, and at least two support brackets attached to said fire-barrier.

2. The fire-barrier, as recited in claim 1, further comprising said plurality of layers being connected only using discrete connectors (42*a, b* and 52*a, b*).

3. The fire-barrier, as recited in claim 2, wherein said plurality of layers are connected to each other and to said at least two support brackets only by said discrete connectors.

4. The fire-barrier, as recited in claim 3, wherein said fire-barrier further comprises a straight-line fire-barrier shaped and sized for installation into a straight-line expansion-space.

5. The fire-barrier, as recited in claim 4, further comprising wherein said fire-barrier is configured to meet criteria mandated by both ASTM E 1399-97 (Reapproved 2005), *Standard Test Method for Cyclic Movement and Measuring the Minimum and Maximum Joint Widths of Architectural Joint Systems* and UL 2079 *Fire Resistance of Building Joint Systems Test* for air leakage (Revised and relocated as 1.14 Mar. 10, 2006).

6. The fire-barrier, as recited in claim 1, wherein said fire-barrier further comprises an L-shaped fire-barrier shaped and sized for installation into an L-shaped expansion-space.

7. The fire-barrier, as recited in claim 6, further comprising wherein said fire-barrier is configured to meet criteria mandated by both ASTM E 1399-97 (Reapproved 2005), *Standard Test Method for Cyclic Movement and Measuring the Minimum and Maximum Joint Widths of Architectural Joint Systems* and UL 2079 *Fire Resistance of Building Joint Systems Test* for air leakage (Revised and relocated as 1.14 Mar. 10, 2006).

8. The fire-barrier, as recited in claim 1, wherein said fire-barrier further comprises a T-shaped fire-barrier shaped and sized for installation into a T-shaped expansion-space.

9. The fire-barrier, as recited in claim 1, wherein said fire-barrier further comprises a cross-shaped fire-barrier shaped and sized for installation into a cross-shaped expansion-space.

10. The fire-barrier, as recited in claim 1, wherein each of said sheets of each of said layers has at least one outer end and where each of said outer ends is aligned with said outer ends of adjacent said sheets of the respective layer forming a commonly aligned end.

11. A fire-barrier for installation into an expansion-space between building units, comprising:

a plurality of layers, each layer comprising,
at least one protective blanket sheet (6),
at least one insulation blanket sheet (14, 24), and
at least one foil sheet (8), where said sheets are parallel to one another along their length, said plurality of layers superimposed and longitudinally offset such that ends of the plurality of layers are not aligned to cause said fire-barrier to have coupling ends that are all male, all female, or a combination of male and female coupling ends;

one of said layers being a bottom layer, having a bottom sheet of the fire-barrier formed from one of said protective blanket sheets;

none of the sheets folded or bent over an end of another of said sheets preventing the formation of gaps between said sheets or said layers in either the fire-barrier or when the fire-barrier is coupled to an adjacent fire-barrier, said layers connected to each other only using discrete connectors (42*a,b* and 52*a,b*) and at least two support brackets (30) each having a first leg attached to said layers shaped to augment the structure of the coupling ends.

12. The fire-barrier, as recited in claim 11, further comprising said at least two support brackets each having a second leg to be fastened to one of said building units.

13. The fire-barrier, as recited in claim 12, further comprising at least two fasteners (36) for attaching said at least two support brackets to said building units.

14. The fire-barrier, as recited in claim 11, wherein said fire-barrier further comprises a straight-line fire-barrier shaped and sized for installation into a straight-line expansion-space.

15. The fire-barrier, as recited in claim 14, further comprising wherein said fire-barrier is configured to meet criteria mandated by both ASTM E 1399-97 (Reapproved 2005), *Standard Test Method for Cyclic Movement and Measuring the Minimum and Maximum Joint Widths of Architectural Joint Systems* and UL 2079 *Fire Resistance of Building Joint Systems Test* for air leakage (Revised and relocated as 1.14 Mar. 10, 2006).

16. The fire-barrier, as recited in claim 11, wherein said fire-barrier further comprises an L-shaped fire-barrier shaped and sized for installation into an L-shaped expansion-space.

17. The fire-barrier, as recited in claim 16, further comprising wherein said fire-barrier is configured to meet criteria mandated by both ASTM E 1399-97 (Reapproved 2005), *Standard Test Method for Cyclic Movement and Measuring the Minimum and Maximum Joint Widths of Architectural*

*Joint Systems* and UL 2079 *Fire Resistance of Building Joint Systems Test* for air leakage (Revised and relocated as 1.14 Mar. 10, 2006).

18. The fire-barrier, as recited in claim 11, wherein intumescent material is affixed onto a coupling area created when said male coupling end of said fire-barrier is coupled with a female coupling end of another fire-barrier.

19. A fire-barrier for installation into an expansion-space between building units, comprising:

a plurality of layers, each layer comprising, at least one protective blanket sheet (6) underlying at least one insulation blanket sheet (14, 24, and/or 34), and at least one fire-resistant support sheet (8), where said sheets are parallel to one another along their length, said plurality of layers superimposed and longitudinally offset such that ends of the plurality of layers are not aligned to cause said fire-barrier to have coupling ends that are all male, all female, or a combination of both;

none of the sheets are folded or bent over an end of another of said sheets, one of said at least one layers being a bottom layer, a bottom sheet of the fire-barrier formed from one of said protective blanket sheets said plurality of layers having a first long edge and a second long edge, a support bracket attached to said first long edge and a second support bracket attached to said second long edge, said support brackets to attach said fire-barrier to said building units forming a shared expansion space and shaped to augment the structure of the coupling ends.

20. The fire-barrier, as recited in claim 19, wherein said at least one protective blanket sheet (6) of each layer, said at least one insulation blanket sheet (14, 24, and/or 34) of each layer, and said at least one fire-resistant support sheet (8) of each layer are all attached to said support brackets.

* * * * *